US008123144B2

(12) United States Patent
Urmson, Jr. et al.

(10) Patent No.: US 8,123,144 B2
(45) Date of Patent: Feb. 28, 2012

(54) RAIL JOINT BARS AND RAIL JOINT ASSEMBLIES

(75) Inventors: W. Thomas Urmson, Jr., Valencia, PA (US); John M. Downey, Ashland, KY (US); John W. Mospan, Pittsburgh, PA (US)

(73) Assignee: Koppers Delaware, Inc., Wilmington, DE (US)

( * ) Notice: Subject to any disclaimer, the term of this patent is extended or adjusted under 35 U.S.C. 154(b) by 0 days.

(21) Appl. No.: 12/353,269

(22) Filed: Jan. 14, 2009

(65) Prior Publication Data

US 2009/0121037 A1 May 14, 2009

Related U.S. Application Data

(62) Division of application No. 11/503,865, filed on Aug. 14, 2006, now Pat. No. 7,490,781, which is a division of application No. 10/838,172, filed on May 3, 2004, now Pat. No. 7,090,143.

(60) Provisional application No. 60/467,451, filed on May 2, 2003.

(51) Int. Cl.
*E01B 11/00* (2006.01)

(52) U.S. Cl. ..... 238/243; 238/153; 238/159

(58) Field of Classification Search ..... 238/143, 238/248, 159, 161, 152, 153, 382, 283, 151, 238/154, 155, 156, 157, 158, 160, 243; D12/51, 49, 52; 277/407, 596, 649, 650, 651, 627, 654

See application file for complete search history.

(56) References Cited

U.S. PATENT DOCUMENTS

| | | | | |
|---|---|---|---|---|
| 1,386,863 | A | 8/1921 | Harrington | |
| 1,474,459 | A | 11/1923 | Wolhaupter | |
| 1,799,381 | A * | 4/1931 | Langford | 238/243 |
| 2,120,428 | A * | 6/1938 | Lee | 238/243 |
| 2,808,995 | A | 10/1957 | Degman | |
| 3,006,553 | A | 10/1961 | Greer | |
| 3,416,728 | A * | 12/1968 | Hamilton, Jr. | 238/152 |
| 3,666,175 | A | 5/1972 | Gill | |
| 3,952,948 | A * | 4/1976 | Nelson et al. | 238/243 |
| 4,635,949 | A | 1/1987 | Lucas et al. | |
| 5,503,331 | A | 4/1996 | Urmson, Jr. et al. | |
| 6,571,524 | B2 | 6/2003 | Pantelides et al. | |

* cited by examiner

*Primary Examiner* — Mark Le

(74) *Attorney, Agent, or Firm* — The Webb Law Firm

(57) ABSTRACT

A rail joint assembly is provided for joining abutting railroad rails with an electrically-insulated joint. The rail joint assembly comprises abutting railroad rails compressing an insulating gasket therebetween and rail joint bars secured through a plurality of holes by fasteners to the adjacent railroad rails. The rail joint bars comprise a body and an insulating spacer comprising a porous mesh screen and washer. A layer of epoxy is sandwiched between a rail joint bar and railroad rail and comprises a rigid epoxy on lateral portions of a first side of a rail joint bar and a flexible epoxy placed on a central portion of the first side of a rail joint bar. Rail joint bars are rectangular shaped and may have a cutout.

4 Claims, 3 Drawing Sheets

RAIL JOINT BARS AND RAIL JOINT ASSEMBLIES

CROSS REFERENCE TO RELATED APPLICATION

This application is a divisional of U.S. patent application Ser. No. 11/503,865, filed Aug. 14, 2006, now U.S. Pat. No. 7,490,781, which is a divisional of U.S. patent application Ser. No. 10/838,172, filed May 3, 2004, now U.S. Pat. No. 7,090,143, which claims the benefit of U.S. Provisional Patent Application No. 60/467,451, filed May 2, 2003, all of which are hereby incorporated by reference.

BACKGROUND OF THE INVENTION

1. Field of the Invention

The present invention relates to a rail joint bar and a rail joint assembly for electrically-isolating sections of rail in a rail system. Particularly, the present invention relates to rail joint bars secured by fasteners to abutting rails of a rail system for creating a rail joint having an electrically-insulating spacer between the rail joint bars and rails, and gaskets between ends of the adjacent railroad rails, all for electrically-isolating adjacent rail sections of a rail system.

2. Description of Related Art

A rail system, which permits more than one train to travel on one stretch of track or rail, is generally divided into sections or blocks. The purpose of dividing rails of a rail system into sections is to detect the presence of a train on a section of rail at any given time. Rail sections of a rail system are electrically isolated from each other to measure a high electrical resistance over the rail section in the absence of a train on any rail section of the system. Upon entry onto a rail section, a train will short circuit adjacent railroad rails in a rail section and the electrical resistance will drop to indicate the presence of the train in the rail section.

Railroad tracks are created generally by welding railroad rails to each other or attaching railroad rails to each other with a steel joint. High-performance, non-metallic joints are typically used for electrically-isolating adjacent rail sections of a rail system in order to create an electrically-isolated section. However, the non-metallic joints are very expensive due to the special high-performance material needed to endure the high tensile and flexural forces exerted on a rail joint as the wheels of a locomotive or rail car pass over the joint. An alternative to a non-metallic joint is a steel rail joint having electrically-insulating material, such as epoxy affixed to the rail joint surface for isolating rail sections. However, these epoxies must be able to endure the high tensile and flexural forces exerted on the railroad rails in order to prevent the electrically-insulating material from peeling off the rail joint. It is, therefore, an object of the present invention to provide a rail joint bar that uses two different types of epoxies whereby the above drawbacks are eliminated.

During creation of a rail system, an electrically-insulated gasket is typically inserted between the ends of adjacent railroad rails when the rails are joined using a rail joint to provide for further electrical isolation of a rail section. The gaskets are usually made of a material that cannot be compressed, such as fiberglass or a polymeric-based material. The gasket is used to environmentally seal the rail ends. Often times, water penetrates between the gasket and the railroad rail ends, thereby compromising the integrity of the material, which unzips, allowing contact between the electrically-isolated railroad rail sections. It is, therefore, an object of the present invention to provide a compressible gasket that overcomes the above problems.

SUMMARY OF THE INVENTION

The present invention provides a rail joint created by compressing a compressible gasket between ends of two adjacent railroad rails secured together with the rail joint bars and fasteners creating an electrically-insulated barrier.

The present invention provides a rail joint bar having a metal body having an upper end, a lower end, a first surface and a second surface and a defining peripheral edge. An optional cutout or easement can be defined on the upper end and/or lower end of the body. At least the first surface and, optionally, the second surface of the body is peened. The first surface of the metal body coacts with an electrically-insulating spacer, which is a non-metallic mesh screen affixed to the first surface of the body. A layer of an adhesive in the form of an epoxy covers both the mesh screen and the first surface of the body. The layer of adhesive used in the insulating layer can include at least two different types of epoxies. A more rigid type of epoxy is uniformly applied on the lateral portions of the first surface of the rail joint. A less rigid and more elastic epoxy is uniformly applied to the central portion of the first surface of the rail joint bar. A plurality of holes is defined on the rail joint bar and is adapted for receiving fasteners used to secure the rail joint bars to the railroad rails in a manner that the layer of epoxy of each rail joint bar contacts a surface of the railroad rail.

The present invention also provides a compressible gasket positioned between the ends of abutting railroad rails secured together by the rail joint bars. The gasket is preferably made of compressible polyurethane having a T-shaped design corresponding to the end of a railroad rail. Alternatively, the gasket is a deformed O-ring gasket that is shaped similar to an end of a railroad rail. During assembly of the rail joint, either gasket is compressed between the ends of the adjacent railroad rails by force exerted on the railroad rails.

The present invention provides for a rail joint assembly that includes a pair of abutting railroad rails having a gasket compressed therebetween and a pair of rail joint bars as previously described secured to the pair of railroad rails by fasteners. The electrically-insulating spacers are positioned between the first rail joint bar and the second rail joint bar resting against the first side and the second side of the abutting railroad rails, respectively. Spacers positioned between each rail joint bar and surfaces of the abutting railroad rails provide a uniform distance between the rail joint bars and the sides of the abutting railroad rails so that the layer of epoxy has a generally even thickness between the rail joint bars and the railroad rail. The assembly further includes a plurality of holes defined on the rail joint bars wherein a plurality of fasteners is used to secure the pair of rail joint bars to the abutting railroad rails via holes in the rails. Cylindrical gaskets are optionally provided inside the plurality of holes of the rail joint bars.

DETAILED DESCRIPTION OF THE INVENTION

Figure 1:
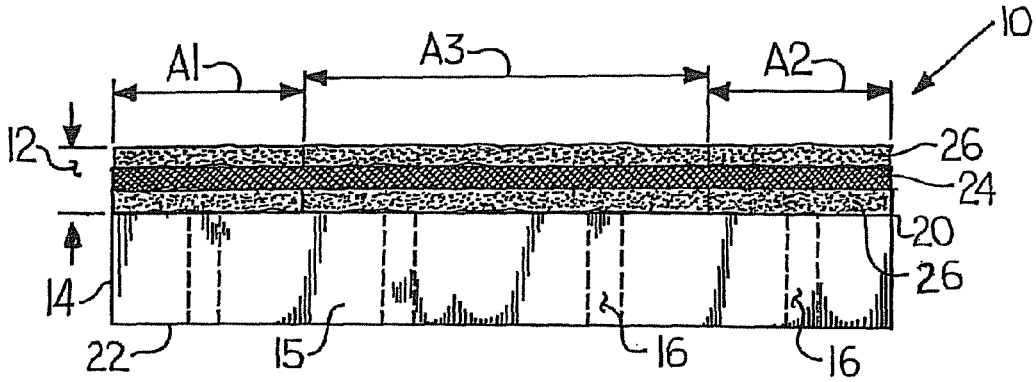
FIG. 1 is a top plan view of a rail joint bar made in accordance with the present invention.
Figure 2:
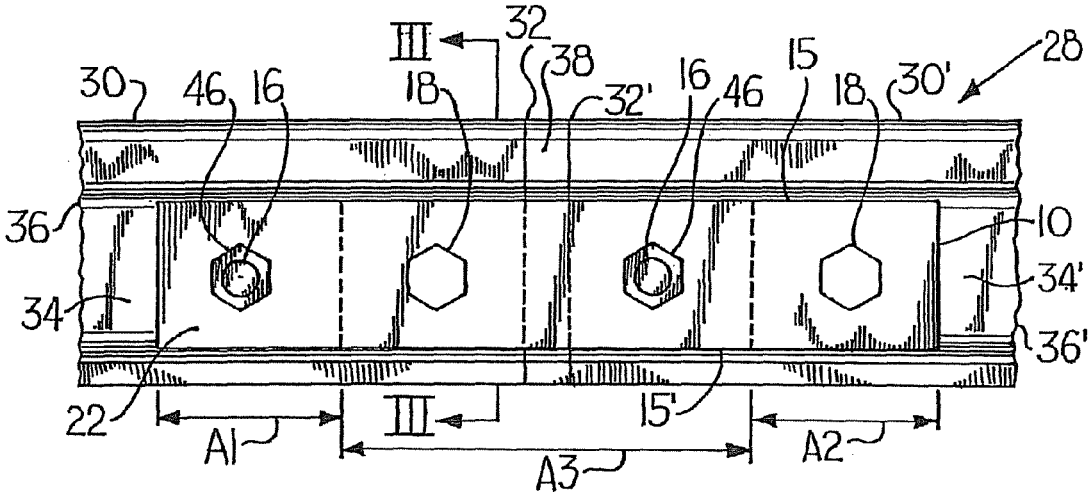
FIG. 2 is an elevational side view of a rail joint assembly utilizing the rail joint bar shown in FIG. 1.

Referencing FIGS. 1 and 2, the present invention is a rectangular-shaped rail joint bar 10 that includes an electrically-insulating layer 12 bonded to a metal body 14. A plurality of holes 16 (shown in phantom) is defined on the rail joint bar 10, wherein the plurality of holes 16 is adapted to receive fasteners 18 for securing the rail joint bar 10 to two adjacent railroad rails 30, 30'. Referencing FIGS. 1 and 2, the body 14 having an upper end 15, a lower end 15', a first surface 20 and a second surface 22 is manufactured from metal material, such as steel or similar strength metal.

Figure 3:
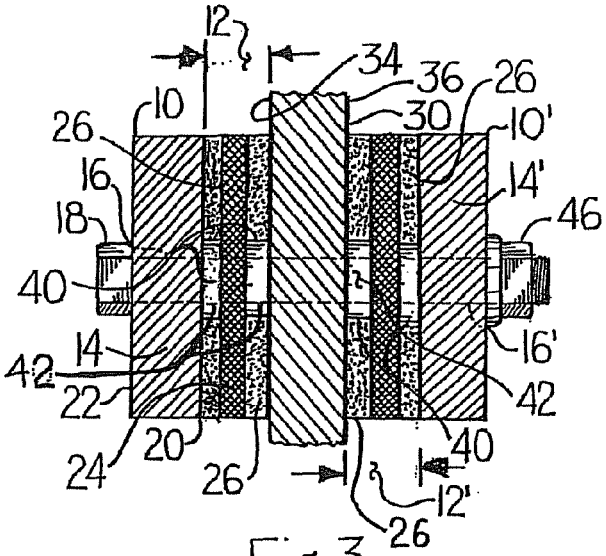
FIG. 3 is a sectional view of the rail joint assembly taken along lines III-III in FIG. 2.

Referencing FIGS. 1 and 3, the insulating layer 12 on the rail joint bar 10 is affixed to or coacts with the first surface 20 of the body 14. The first surface 20 of the body 14 can be peened to create a more secure attachment of the insulating layer 12. Optionally, the first surface 20 and/or the second surface 22 of the body 14 is peened. In reference to the present invention, the word "peened" means dimpled or roughened through a peening process that is known in the art. The insulating layer 12 includes a porous member such as a mesh screen 24 affixed to the first surface 20 of the body 14. An electrically-insulating epoxy 26 covers both the mesh screen 24 and the first surface 20 of the body 14. The mesh screen 24, typically made of non-metallic, electrically-insulating material such as fiberglass or plastic, is used to facilitate a uniform dispersion of the epoxy 26 evenly across the first surface 20 of the body 14. Preferably, an epoxy layer 26 is provided on opposite sides of the mesh screen 24 as shown in FIGS. 1 and 3. The surfaces defining the plurality of holes 16 of the rail joint bar 10 can be electrically insulated via bushings.

Referencing FIGS. 1 and 2, the first surface 20 of the rail joint bar 10 is divided into three (3) separate areas designated as A1, A2 and A3. The epoxy 26 forming the insulating layer 12 can include two different types of epoxies having different physical characteristics. A first type of epoxy used in areas A1 and A2 is characteristically more rigid, having a higher durometer reading, i.e., durometer hardness, than a second type of epoxy used in area A3. The first epoxy or adhesive 26 is dispersed across the first surface 20 of the body 14 on lateral portions A1 and A2 of the first surface 20 and the second epoxy or adhesive 26 on a central portion A3 of the first surface 20 between portions A1 and A3. The second type of epoxy used in area A3 allows for greater flexibility in area A3 of railroad rails 30, 30' than in areas A1 and A2, because the flexural and tensile forces exerted on the railroad rails 30, 30' is greater in area A3 than in areas A1 and A2 when a locomotive and railcars pass over the rail joint assembly. The two different types of epoxy 26 used in the insulating layer 12 result in a more durable rail joint bar 10 when joining two railroad rails 30, 30' as shown in FIG. 2. The approximate mechanical property values of the first type of epoxy 26 for areas A1 and A2 are approximately 3500 psi or greater, and preferably 3800 psi, tensile strength, and preferably at least 0.001, but preferably between 0.001-0.002, inch per inch elasticity. In comparison, the approximate mechanical property values of the second type of epoxy 26 for area A3 are preferably at least 2000 psi tensile strength, and preferably within the range of 2000-3100 psi (and preferably 2500 psi) tensile strength, and at least 0.003, but preferably within the range of 0.003-0.006 (and more preferably 0.0045), inch per inch elasticity. Such epoxies are manufactured by Lord Corporation, Thermoset Division.

Figure 7:
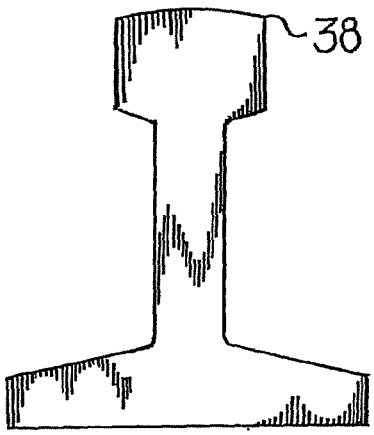
FIG. 7 is a front elevational view of a gasket made in accordance with a first embodiment of the present invention.

FIGS. 2 and 3 show a rail joint assembly 28 used in joining abutting railroad rails 30, 30' together. The first railroad rail 30 having a first railroad rail end 32 and a second railroad rail 30' having a second railroad rail end 32' are T-shaped and have a first side 34, 34' and a second side 36, 36', respectively. The first railroad rail end 32 of the first railroad rail 30 is joined to the second railroad rail end 32' of the second railroad rail 30' via rail joint bars 10, 10' shown in FIG. 3. Gasket 38 is shown between the first railroad rail end 32 and the second railroad rail end 32'. Gasket 38 also has a T-shaped design corresponding to the T-shaped design of the railroad rails 30, 30' as shown in FIG. 7. Gasket 38 can be made of a compressible, electrically-insulating material, such as polyurethane or rubber. Prior art electrically-insulating spacers looked like gasket 38 except they were made of an electrically-insulating material that was substantially incompressible, such as fiberglass. The railroad rails 30, 30' are positioned relative to each other so that the gasket 38 is compressed, thus preventing water from penetrating between the railroad rail ends 32, 32'. Also, a machine can pre-compress the gasket 38 so the railroad rails 30, 30' are at a fixed distance. For example, an eight-ton compression machine can be used to compress the gasket 38 to a fixed width, such as 0.060 inch. The compressed gasket 38 overcomes the problem that arises when water penetrates a non-compressible gasket, such as a fiberglass or polymeric-based gasket, and the gasket material begins to unzip, thereby compromising the electrical isolated nature of the railroad rails.

In further reference to FIGS. 2 and 3, the rail joint assembly 28 includes two rail joint bars 10, 10' attached to railroad rails 30, 30'. FIG. 3, which is a sectional view of FIG. 2 taken at lines III-III, shows the rail joint assembly 28 with the rail joint bars 10, 10' attached to the first railroad rail 30. Rail joint bar 10 is fastened to the first side 34 of the first railroad rail 30, and the rail joint bar 10', which is identical to rail joint bar 10, is fastened to the second side 36 of the first railroad rail 30. Rail joint bar 10' also has an electrically-insulating layer 12' affixed to a metal body 14' and a plurality of holes 16' defined on the rail joint bar 10'. Each of the plurality of holes 16 in rail joint bar 10 is aligned with the corresponding slot 16' in rail joint bar 10'. Washer-shaped spacers 40 having a spacer slot 42 for receiving fasteners 18 is positioned between the insulating layers 12, 12' of rail joint bars 10, 10' and the first side 34 and the second side 36 of the first railroad rail 30, respectively. Each spacer 40 is made of an electrically-insulating material, such as fiberglass or plastic. The spacer slot 42 in each spacer 40 is aligned with the holes 16, 16' in rail joint bars 10, 10', respectively. In this arrangement, the mesh screen 24 may be eliminated. A fastener 18, such as a bolt, is placed through each corresponding slot 16, 16' of rail joint bars 10, 10' via spacers 40 and the first railroad rail 30. The spacers 40 enable the insulating layers 12, 12' on rail joint bars 10, 10' to maintain their uniformity whenever the rail joint bars 10, 10' are fastened to the railroad rails 30, 30' as shown in FIG. 2. This uniformly prevents a portion of the respective insulating layers 12, 12' on rail joint bars 10, 10' from being crushed, which can result in the insulating layers 12, 12' being stripped from the respective bodies 14, 14', thus compromising the electrical isolation of the railroad rail sections. The fastener 18 can have threads at one end for receiving a nut 46. The nut 46 can either be threaded or welded to the fastener 18.

Figure 6:
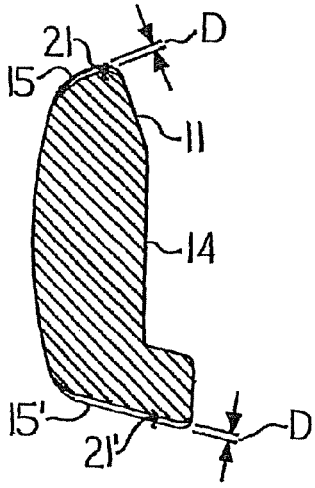
FIG. 6 is a sectional view of the rail joint bar taken along lines VI-VI shown in FIG. 5.
Figure 4:
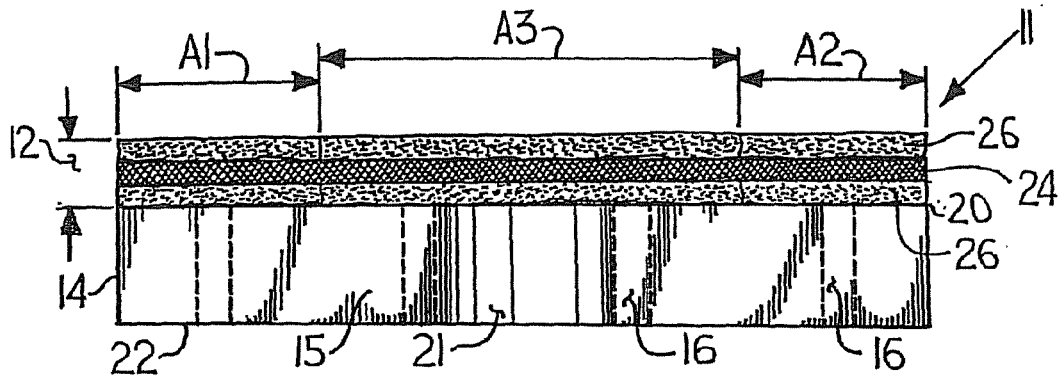
FIG. 4 is a top plan view of a second embodiment of a rail joint bar having a cutout made in accordance with the present invention.
Figure 5:
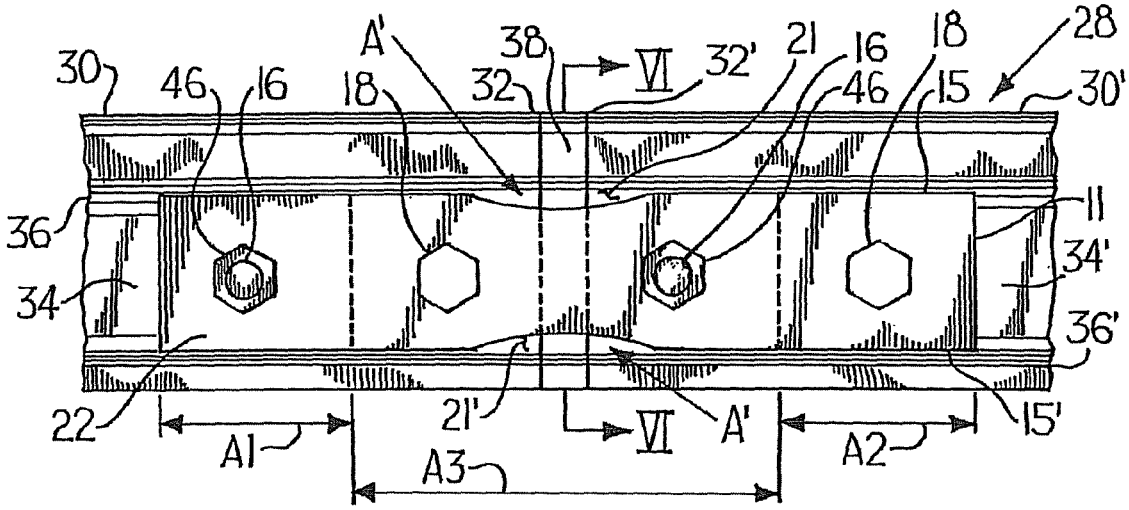
FIG. 5 is a elevational side view of a rail joint assembly utilizing the rail joint bar shown in FIG. 4.

FIGS. 4-6 show a second embodiment of a rail joint bar 11 that is similar to rail joint bar 10, except that a cutout recessed portion or easement 21 is defined on the upper end 15 of the body 14. The character references used in FIGS. 1-3 also identify like parts in FIGS. 4-6. A cutout or easement 21' can also be defined on the lower end 15' of the body as shown in FIGS. 5 and 6. Referring to FIGS. 4 and 5, the cutouts 21, 21', located at the center or intermediate section of the body 14, typically extend a portion of the length of the body 14 in area A3, but can also extend into areas A1 and A2 (not shown). Hence, a width of the intermediate section having the cutouts 21, 21' as defined between the upper end 15 and lower end 15' is less than the width at the remainder of the body 14. The depth D of the cutouts 21, 21' (shown in FIG. 6) can range from 0.060 to 0.080 inch, which is typically below the decarb zone on the surface of a steel plate.

Referring to FIGS. 4 and 5, the cutouts 21, 21' defined on the body 14 allow for more epoxy 26 to be used at the center of rail joint bar 11 than in rail joint bar 10, as previously shown in FIGS. 1-3, because the epoxy 26 flows and sets on top of the cutouts 21, 21' as shown by arrows A'. Because the epoxy 26 is deeper in the cutouts 21, 21' of rail joint bar 11, the epoxy 26 is less likely to crack and separate due to fatigue of the rail joint bar 11. Also, the cutouts 21, 21', which are typically below the decarb zone of the body 14, allow for better adhesion of the epoxy 26 to the upper end 15 and lower end 15', respectively, of the body 14, thus eliminating possible unzipping of the epoxy 26 from the railroad rails 30, 30'.

Figure 8:
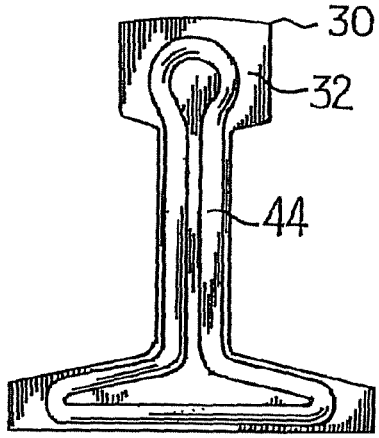
FIG. 8 is a front elevational view of an O-ring gasket made in accordance with a second embodiment of the present invention.

FIG. 8 shows a gasket 44 made in accordance with a second embodiment of the present invention. Gasket 44 can be an O-ring-like or ring-shaped gasket having a circular cross-section that has been formed to fit the shape of the railroad rail end 32 of the first railroad rail 30. Gasket 44 can be made of a compressible, electrically-insulating material, such as polyurethane or rubber. Gasket 44 can also be pre-compressed in a manner similar to gasket 38.

Figure 9:
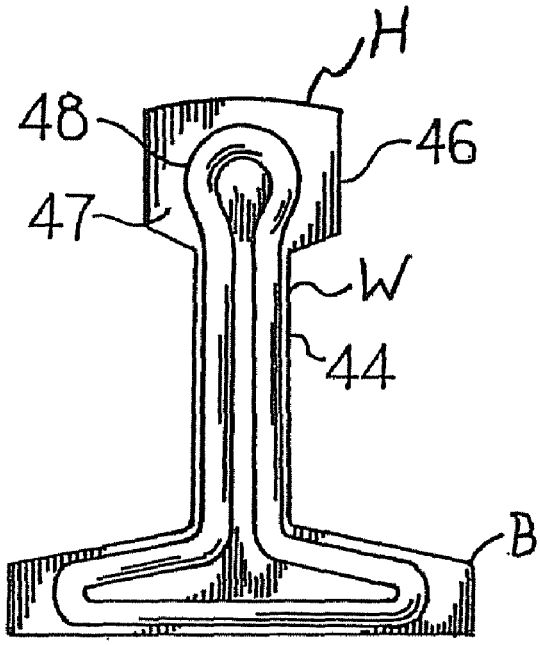
FIG. 9 is a front elevational view of a gasket arrangement made in accordance with another embodiment of the present invention.
Figure 10:
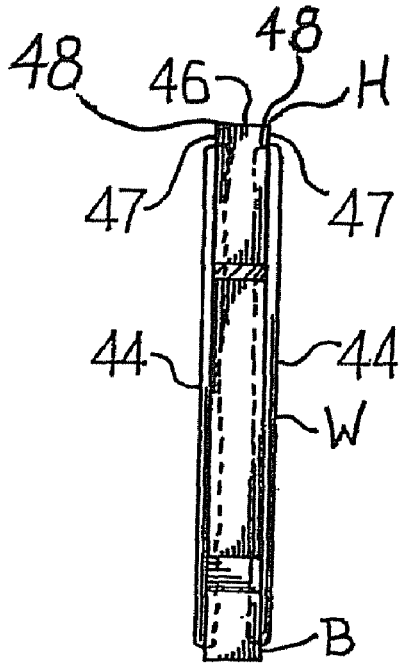
FIG. 10 is a side elevational view of the gasket arrangement shown in FIG. 9.

More preferably, in another embodiment as shown in FIGS. 9 and 10, two gaskets 44 made of a compressible electrically-insulating material, such as polyurethane or rubber, are provided on opposite sides of and coact with a T-shaped insulated spacer 46, which can be made of fiberglass or other electrically-insulating material. Preferably, the material of spacers is substantially incompressible. Preferably, a receiving groove 48 is found on each face surface 47 of the spacer 46 (of which one is shown). A portion of the gasket 44 extends from each face surface 47 of the T-shaped spacer. The gaskets 44 are compressed in the same manner as gasket 38. The spacer 46 has a profile similar to that of the shape of rail ends (also shown in FIG. 8) and has a body with a head H or horizontal member, a web W and a base B.

Figure 11:
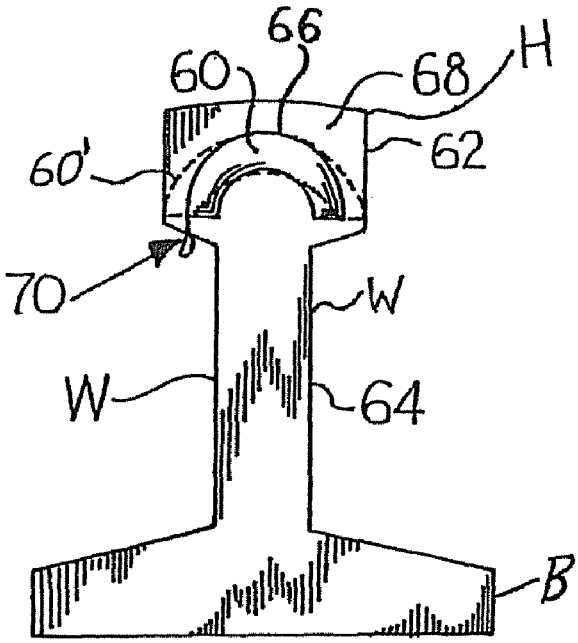
FIG. 11 is a front elevational view of a gasket arrangement made in accordance with another embodiment of the present invention.
Figure 12:
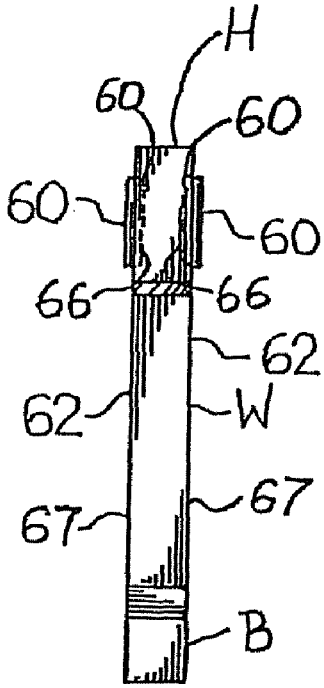
FIG. 12 is a side elevational view of the gasket arrangement shown in FIG. 11.

FIGS. 11 and 12 show another embodiment similar to that shown in FIGS. 9 and 10, wherein gaskets 60 are positioned on opposite faces 62 of and coact with a T-shaped substantially incompressible insulation spacer 64. Grooves 66 are found on each face 62 for receipt of the gaskets 60 made of a compressible, electrically-insulating material, such as rubber or polyurethane. The gaskets 60 are substantially convex shaped, hat shaped or arcuate shaped and may extend across or substantially across the entire horizontal member 68 of the spacer 64 (as shown by gasket 60' shown in phantom). Portions of the gaskets 60 extend from face surfaces 67. The purpose of this arrangement, which is sandwiched between adjacent rail ends, is to insulate adjacent rails and prevent and deflect water 70 from penetrating the web portion W of the spacer 64 positioned between two adjacent rails. Further, for the purposes used herein, the spacer 64 is incompressible relative to the gaskets 44 and 60. The gaskets 60 can have a circular cross-section.

While the present invention is satisfied by embodiments in many different forms, there is shown in the drawings and described in detail herein the preferred embodiments of the invention, with the understanding that the present disclosure is to be considered as exemplary of the principles of the invention and is not intended to limit the invention to the embodiments illustrated. Various other embodiments will be apparent to and readily made by those skilled in the art without departing from the scope and spirit of the invention. The scope of the invention will be measured by the appended claims and their equivalents.

The invention claimed is:

1. A rail joint bar for joining two abutting railroad rails, comprising:

a metal body having a first surface, a second surface, an upper end, a lower end and a defining peripheral edge, the first surface positioned opposite from the second surface, the upper end and lower end positioned between the first and second surfaces, wherein a recessed portion is defined at an intermediate section of the upper end, the recessed portion extending from the first surface to the second surface, the recessed portion positioned below a decarb zone on the first surface of the metal body, wherein a width, as defined between the upper end and the lower end, is less at the section of the body that contains the intermediate section of the upper end than at the remainder of the body, a plurality of holes defined in the body; and an insulating layer comprising a mesh screen and an adhesive positioned on opposite sides of the mesh screen, the insulating layer sandwiched between the body and the two abutting railroad rails and securing the rail joint bar to the railroad rails, wherein a portion of the adhesive is positioned on the upper end of the body in the recessed portion, the adhesive being deeper at the recessed portion than at the remainder of the body.

2. The rail joint bar as claimed in claim 1, wherein a recess is defined on the lower end of the body.

3. The rail joint bar as claimed in claim 1, wherein the recessed portion is arcuate shaped.

4. The rail joint bar as claimed in claim 1, wherein a depth of the recessed portion is between about 0.060 to 0.080 inch.

* * * * *

UNITED STATES PATENT AND TRADEMARK OFFICE

CERTIFICATE OF CORRECTION

PATENT NO. : 8,123,144 B2
APPLICATION NO. : 12/353269
DATED : February 28, 2012
INVENTOR(S) : W. Thomas Urmson, Jr. et al.

It is certified that error appears in the above-identified patent and that said Letters Patent is hereby corrected as shown below:

Column 6, Lines 40-44, Claim 1, delete "from the first surface ... the upper end and the" and insert -- from the first surface to the second surface, the recessed portion extending substantially upwardly along a lateral cross-section from a first end of the recessed portion at the first surface and downwardly to a second opposite end of the recessed portion at the second surface, the first end of the recessed portion extending from a substantially vertical portion of the first surface, wherein a width, as defined between the upper end and the --

Signed and Sealed this
Twenty-second Day of May, 2012

David J. Kappos

David J. Kappos
*Director of the United States Patent and Trademark Office*